US007367405B2

(12) United States Patent
Murray

(10) Patent No.: US 7,367,405 B2
(45) Date of Patent: May 6, 2008

(54) ELECTRIC PRESSURE ACTUATING TOOL AND METHOD

(75) Inventor: Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 315 days.

(21) Appl. No.: 11/173,207

(22) Filed: Jul. 1, 2005

(65) Prior Publication Data

US 2006/0048949 A1 Mar. 9, 2006

Related U.S. Application Data

(60) Provisional application No. 60/607,227, filed on Sep. 3, 2004.

(51) Int. Cl.
*E21B 34/12* (2006.01)

(52) U.S. Cl. ..... 166/383; 166/386; 166/387; 166/66.7; 166/66.6

(58) Field of Classification Search ..... 166/383, 166/386, 387, 66.6, 66.7, 65.1
See application file for complete search history.

(56) References Cited

U.S. PATENT DOCUMENTS 3,038,101 A * 6/1962 Schlesinger ..... 315/382
3,158,207 A * 11/1964 Rowley ..... 175/16
3,306,089 A * 2/1967 Brayman ..... 72/56
3,620,313 A * 11/1971 Elmore et al. ..... 175/14
4,917,191 A 4/1990 Hopmann et al. ..... 166/381
4,967,841 A 11/1990 Murray ..... 166/312
5,004,050 A * 4/1991 Sizonenko et al. ..... 166/248
5,435,390 A 7/1995 Baugh et al. ..... 166/285
5,590,713 A 1/1997 Baugh et al. ..... 166/53
5,833,002 A 11/1998 Holcombe ..... 166/291
5,856,790 A 1/1999 Baugh et al. ..... 340/854.6
5,862,865 A 1/1999 Murray et al. ..... 166/373
5,906,238 A 5/1999 Carmody et al. ..... 166/53
6,260,616 B1 7/2001 Carmody et al. ..... 166/66
6,450,255 B2 9/2002 Carmody et al. ..... 166/53
6,484,800 B2 11/2002 Carmody et al. ..... 166/53
6,612,547 B2 9/2003 Carmody et al. ..... 251/343
2003/0098181 A1 5/2003 Aronstam et al. ..... 175/65
2003/0201101 A1* 10/2003 Kostrov et al. ..... 166/249
2004/0112642 A1 6/2004 Krueger et al. ..... 175/57

* cited by examiner

*Primary Examiner*—William Neuder
*Assistant Examiner*—Nicole Coy
(74) *Attorney, Agent, or Firm*—Cantor Colburn LLP

(57) ABSTRACT

Disclosed herein is a downhole tool actuation arrangement. The arrangement includes a housing having a chamber, at least one piston in operable communication with the chamber and at least one electrode exposed to the chamber. The electrodes are receptive to a power source. Further disclosed is a method for actuating a downhole tool. The method includes discharging a voltage source through at least one electrode to cause a pressure wave in a fluid surrounding the at least one electrode and moving at least one piston in response to the pressure wave.

6 Claims, 1 Drawing Sheet

ELECTRIC PRESSURE ACTUATING TOOL AND METHOD

CROSS-REFERENCE TO RELATED APPLICATIONS

This application claims the benefit of an earlier filing date from U.S. Ser. No. 60/607,227, filed Sep. 3, 2004, the entire contents of which is incorporated herein by reference.

BACKGROUND

In the hydrocarbon exploration and recovery arts and other similar "downhole" arts, downhole tools are often "set" utilizing pressure from a pressure source such as a remote pump or a power charge. For example, a commercially available system from Baker Oil Tools, Houston, Tex. known as a "Baker E-4 pressure setting tool" with a firing head, utilizes a power charge. The power charge is ignited at an appropriate time. As the charge burns it creates expanding gas which is translated by a piston arrangement into either hydraulic fluid pressure for an inflatable or into mechanical energy to ratchet slips into place in a mechanical packer.

While the "E-4" product is quite capable of operating well, the power charge component thereof creates some difficulties with respect to transportation, importation and exportation due to varying laws regarding the transportation of "hazardous materials". Because of these potential difficulties, it would be helpful to the industry to have a setting tool that operates similarly to the "E-4" tool but does not require the use of hazardous materials.

SUMMARY

Disclosed herein is a downhole tool actuation arrangement. The arrangement includes a housing having a chamber, at least one piston in operable communication with the chamber and at least one electrode exposed to the chamber. The electrodes are receptive to a power source.

Further disclosed is a method for actuating a downhole tool. The method includes discharging a voltage source through at least one electrode to cause a pressure wave in a fluid surrounding the at least one electrode and moving at least one piston in response to the pressure wave.

BRIEF DESCRIPTION OF THE DRAWINGS

Referring now to the drawings wherein like elements are numbered alike in the several Figures.

DETAILED DESCRIPTION

Figure 1:
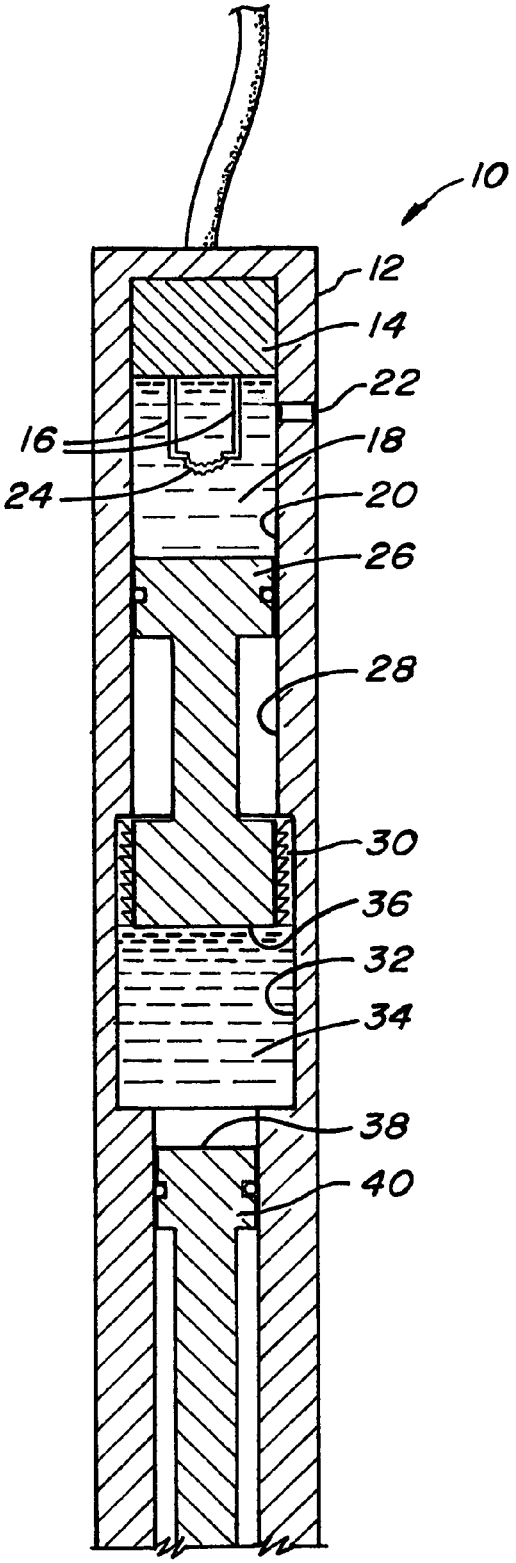
FIG. 1 is a schematic view of a pressure actuation component of a setting tool.

An actuation tool such as a setting tool having no need for a remote pressure source such as a surface hydraulic pump and reservoir or mechanical impact source, therefore runnable on wireline, and in addition not requiring a power charge, is realized by utilizing a submerged discharge electrical pressure source. Referring to FIG. 1, one embodiment of an actuation or setting tool 10 is illustrated. A housing 12 is connected to a wireline by which the tool 10 is run and through which electrical energy is deliverable to the tool 10. It is also to be understood that different power sources are also applicable such as seismic electric line, coil tubing with an electric feed, batteries, etc. Within housing 12 is a capacitor bank 14. The capacitor bank 14 functions to store voltage for rapid release upon command. The stored voltage is delivered to and released through at least one electrode (if a suitable ground is available) or a pair of electrodes 16 (as illustrated) where an arc will be formed upon discharge of capacitor bank 14. The electrodes 16 are immersed in a fluid 18 within a cavity 20. In the illustrated embodiment a port 22 is provided for inflow of fluid from around the tool 10. The fluid 18 in chamber 20 may be of many different chemical constitutions but commonly will be water or oil.

When triggered by a well operator, a downhole intelligent controller or even a simple switch configured to cause the discharge of the capacitor bank 14 at the appropriate time, an arc 24 forms between the two electrodes 16. In the volume of fluid surround the arc 24, an instantaneous vaporization (or other pressure creating modification) of the fluid takes place. The vaporization creates a pressure spike in the form of a shock wave that then propagates through the fluid 18. When the shock wave encounters a material boundary such as housing 12 or a piston the energy of the shock wave is absorbed. Some of this energy (a device designed to focus the shockwave on the piston is disclosed hereinafter) is absorbed by the piston 26 causing the same to move in piston bore 28. The amount of movement of the piston 26 is dependent upon the amplitude of the shockwave. Shockwave amplitude is directly proportional to the fluid 18 density and inversely proportional to the square of electric discharge duration. It should be noted that although FIG. 1 illustrates the piston 26 as an intermediary component utilized to compress a trapped fluid, piston 26 could be mechanically connected to the tool to be actuated, such arrangement foregoing the trapped fluid chamber.

In the embodiment illustrated in FIG. 1, the piston 26 is a ratcheting piston. This arrangement is selected so that smaller amplitude shockwaves are useable by the actuation tool. The piston 26 includes ratchet teeth 30, which engage a ratchet recess 32. Through the ratchet arrangement, each shockwave (generated by capacitor discharge), causes an incremental movement of piston 26, is cumulative in effect with respect to piston 26 because of the ratchet arrangement. The piston may only move in one direction; it is mechanically prevented from moving in the opposite direction. Thereby such is also cumulative with respect to a fluid 34 that is trapped in recess 32 between surface 36 of piston 26 and surface 38 of piston 40. Fluid pressure on piston 40 (this could be one or more pistons that may be cylindrical and arranged annularly or may be annular pistons; the trapped fluid pressure is not bound to one piston) is utilized as is the power charge expansion fluid in the commercially available E-4.

In another embodiment, the ratchet teeth are not necessary as the frequency of discharge at the electrodes 16 is altered such that pressure in the fluid 18 accumulates at a rate similar to that of a power charge in the prior art E-4 device. More specifically, the discharge frequency is such that pressure generated in a discharge event is not dissipated as subsequent discharge events are occurring. The frequency of pulses is controlled to build and then maintain a substantially constant pressure. The exact time required to set a specific tool depends on a number of factors such as the complexity of the tool being set, the hydrostatic pressure in the immediate vicinity of the tool being set and the temperature of the well, especially in the vicinity of the tool being set. As the complexity of the tool increases, the setting time increases; as hydrostatic pressure increases, the setting time increases; and as temperature increases the setting (or actuation) time decreases. For example, time factors for setting tools might be about 5-10 seconds for more simple tools in easier-to-set conditions while more complex tools that might be in harder-to-set conditions could have a time factor to set of about 40-60 seconds. It is important to recognize that these are only examples and that other times to set could be applicable for certain situations or constructions. The pulse arrangement disclosed herein allows for adaptation to these variables in the field and on-the-fly. Therefore, much greater control and accuracy of the setting process is obtainable using the method and arrangement disclosed herein.

Figure 2:
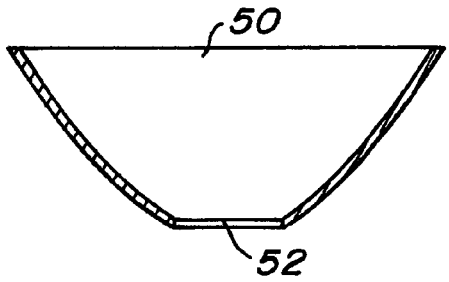
FIG. 2 is a cross-sectional view of a focuser.

In each of the foregoing embodiments a focuser 50 (see FIG. 2), may be frustoconical or parabolic in configuration. The focuser 50 includes an opening 52 in a location calculated to release an incident pressure wave toward a target surface. The focuser 50 may be placed at the electrode discharge location to focus the resulting pressure wave. Such focusing is beneficial to functionality of the arrangement because where the pressure is focused on the piston, less of the pressure wave will be lost to non-functional portions of the arrangement.

It is also important to note that the arrangement as described herein allows for pressure generation to be started and stopped at will. This is beneficial in that it means a downhole tool may be partially set and then held in that position before being completed. For example, a setting sequence of a packer can be controlled; the packer can be set and allowed to stand for a period of time before being final set and released. Such control of the setting or other actuation process was not available with the prior art E-4 system. Control is advantageous in that it ensures a good set of the target tool.

The discharge may be controlled from a surface location or downhole location and may be remote or local. In one embodiment, control would be tighter through the incorporation of one or more sensors at the arrangement. Sensors might include pressure in the chamber 20, movement in piston 26 or other of the employed pistons. In addition or substitutionally operational sensors in the tool being set to verify that it is in a particular condition may be employed.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A method for actuating a downhole tool comprising:

discharging a voltage source through at least one electrode to cause a pressure wave in a fluid surrounding the at least one electrode;

moving at least one piston in response to the pressure wave; and a downhole tool by the moving of the piston.

2. A method for actuating a downhole tool as claimed in claim 1 wherein the moving is incremental and includes ratcheting of the at least one piston.

3. A method for actuating a downhole tool as claimed in claim 1 wherein the moving of the at least one piston further includes compressing a fluid in a chamber that is in operable communication with the at least one piston.

4. A method for actuating a downhole tool comprising:

discharging a voltage source through at least one electrode to cause a pressure wave in a fluid surrounding the at least one electrode;

moving at least one piston in response to the pressure wave; and controlling a setting sequence of a packer.

5. A method for actuating a downhole tool as claimed in claim 4 wherein said controlling is partially setting, holding and final setting.

6. A method for actuating a downhole tool as claimed in claim 5 wherein said controlling further includes releasing the setting tool.

* * * * *